United States Patent [19]

Robbins

[11] Patent Number: 4,591,215

[45] Date of Patent: May 27, 1986

[54] MERCHANDISING AND DISPLAY DEVICE

[76] Inventor: Howard Robbins, 1925 N. Chybourn, Chicago, Ill. 60614

[21] Appl. No.: 651,596

[22] Filed: Sep. 17, 1984

[51] Int. Cl.[4] ..... A47B 81/00

[52] U.S. Cl. ..... 312/234.3; 312/138 R; 312/234; 312/111; 312/117

[58] Field of Search ..... 312/234.3, 234.1, 234.2, 312/234, 283, 286, 244, DIG. 33, 138 R, 111, 117

[56] References Cited

U.S. PATENT DOCUMENTS

| | | | |
|---|---|---|---|
| 2,093,530 | 9/1937 | Walmsley | 312/234.3 |
| 2,174,068 | 9/1939 | Citron | 312/234 |
| 2,286,427 | 6/1942 | Levensten | 312/DIG. 33 |
| 2,530,220 | 11/1950 | Belcher | 312/234 |
| 2,723,484 | 11/1955 | Nelson, Jr. | 312/111 |
| 2,739,863 | 3/1956 | Ferris | 312/330 R |
| 2,846,284 | 8/1958 | Fitzgerald | 312/138 R |
| 3,877,766 | 4/1975 | Seebald | 312/244 |
| 4,130,326 | 12/1978 | Hornblad | 312/138 R |
| 4,217,012 | 8/1980 | Klaus | 312/111 |
| 4,285,558 | 8/1981 | Medford | 312/117 |

FOREIGN PATENT DOCUMENTS

| | | | |
|---|---|---|---|
| 812594 | 7/1951 | Fed. Rep. of Germany | 312/234.3 |
| 1424301 | 11/1965 | France | 312/234 |

*Primary Examiner*—Victor N. Sakran

*Attorney, Agent, or Firm*—Robert E. Browne; Ralph R. Rath

[57] ABSTRACT

A merchandising and display device includes a portable cabinet that has an inner compartment open at one end for slideably receiving a plurality of trays that are retained therein by a removable cover and a conversion kit attached to the cabinet and having a display surface divided into a plurality of individual segments each having individual identifying indicia corresponding with indicia attached to the exposed ends of the trays. A transparent cover extends across the display surface and is releasably secured to connecting means forming part of the kit so that the displayed articles may be kept under lock and key while a supply of each article is maintained in the trays.

3 Claims, 5 Drawing Figures

MERCHANDISING AND DISPLAY DEVICE

DESCRIPTION

1. Technical Field

The present invention relates generally to display devices and, more particularly, to a novel apparatus which can be utilized for displaying a plurality of discrete articles and, at the same time, storing of a supply for each of the discrete articles as part of the display device.

2. Background Prior Art

The merchandising of articles in various different forms has been in existence for many, many years. Marketing surveys have repeatedly shown that the manner of packaging and displaying an article for sale has a large bearing on the minds of the ultimate purchaser in selection of one particular product over another product.

Thus, manufacturers and retailers are constantly striving to provide products which are neatly packaged and can easily be displayed at the point of sale. While the packaging and display of articles of merchandise for sale is extremely important, actual surveys have shown that such factors may be secondary considerations to the ultimate selection of one product over another, and these surveys have shown that the specific location of a product within a store, and even the location of the product with respect to a particular display cabinet, such as the position of the shelf displaying such product, may become even more important for marketing of certain products.

In most stores, articles that are displayed for sale usually have a supply of such articles stored in close proximity to the point of display so that the purchaser can easily pick up a boxed or packaged article after making the appropriate selection from the articles that are clearly visible and are on a display on a shelf.

In many stores, such as hardware and department stores, many smaller articles are stored in open-top trays on a shelf and either the article itself or a graphic description of the article appears on the front of the tray for identifying the product within the tray. For example, in the sale of hardware articles, such as nuts, washers, screws, and small bolts, the articles may be stored in individual trays that are part of a cabinet with the front surfaces of the trays being exposed to the aisle for the ultimate purchaser to inspect and make the proper selection. Such display may be in the form of the specific size, type and configuration of a certain selected product, such as screws, which may also have a picture of the article displayed on the front of the tray.

In many types of environments, it is extremely desirable to have the articles stored in such a fashion that they can be transported by the merchandiser and yet be readily available for inspection at the point of sale. Thus, for example, in many sporting events, such as football and basketball games, particularly the college and high school levels, many types of small articles, such as pins and favors, may be marketed in the stands or at entrances by individuals rather than being displayed at a common point of sale. For example, at many college football games, various pins and other paripherna lia may be offered for sale and usually be cover a variety of different sizes, configurations, shapes and colors of pins, sometimes identifying the respective teams that are competing on the field, the home team colors and various other products that are associated with the particular sport.

Since many of these types of articles have an extremely limited appeal or value in terms of time and thus are sold by individuals on a part-time or entrepreneur-type situations, the maintenance of appropriate stock of the faster-selling articles becomes extremely critical and the manner of displaying the articles in an outdoor environment becomes even more critical when a single merchandiser may be offering a large number of such articles at the same time. Various types of storage and display devices have been proposed for such environments and for other similar environments, such as local fairs and other public functions where various articles, sometimes made by the merchandiser or made for the merchandiser, are displayed for sale.

In such types of environments, it is extremely helpful to the merchandiser to have the various articles well organized in terms of the display of the articles and a ready association of the supply of the same article whenever a purchaser makes a selection from a large group. While various types of storage and display devices are presently being marketed, merchandisers are constantly striving to attempt to provide a better display for the product, which will have the necessary appeal to the ultimate purchaser and still have the supply of article readily available to the merchandiser in the event that a purchaser selects a given article. While various types of portable, generally self-contained, units have been proposed and are presently marketed, the need still exists for a merchandising and display device that is capable of simultaneously displaying a large number of individual discrete articles and properly correlating a supply of each of said large number of discrete articles that are readily accessible to the merchandiser.

SUMMARY OF THE INVENTION

According to the present invention, the merchandising and display system has been developed which utilizes generally conventional, readily-available parts that can easily be assembled into a novel display device that also is capable of having the supplies of articles stored directly in conjunction therewith and easily transportable from one location to another without any set-up or tear-down time requirement, which are extremely undesirable in many of the environments discussed above.

In accordance with the present invention, a generally commercially-available cabinet has top, bottom and side walls defining a compartment that is closed at one end and is open at an opposite end with a plurality of trays slideable into and out of the compartment from the opposite end, and can easily and inexpensively be converted into a merchandising and storage display device that can readily be carried by the merchandiser from one point to another, can easily be set-up by placing the device at a proper level with respect to the eye level of ultimate purchasers, and at the same time provides a readily-accessible storage for each of the discrete articles being displayed.

More specifically, the adaptor or conversion kit for converting a portable multi-tray cabinet consists of a hollow frame structure that defines a hollow passageway, the internal periphery which conforms to the peripheral configuration of the cabinet and can be telescoped over one end of the cabinet into juxtaposed position with associated walls that form the closed compartment for the cabinet. The frame structure can easily be substantially permanently attached to the remainder of the portable cabinet utilizing readily-available fasteners, such as screws.

The frame structure has a partition or front which closes the hollow passage intermediate opposite ends and defines an exposed display surface for a plurality of discrete articles, such as pins.

The display surface is divided into a plurality of individual display segments, and each segment has an individual identifying indicia thereon. The display surface, with the respective discrete articles attached thereto, is preferably completely enclosed by a transparent cover which is received into the frame structure and is releasably secured thereto, while the adaptor kit has a plurality of individual corresponding identifying indicia respectively corresponding to the indicia on each of the display segments which are attached to the exposed ends of the trays that are housed within the cabinet. The transparent cover is preferably releasably locked onto the frame structure and, for this purpose, the frame structure has a pair of brackets that define opposed confronting slots which are adapted to respectively receive opposite edges of the transparent cover at one end thereof while the opposite end has a lock which can be opened and closed with a key to lock the transparent cover to either the frame structure or directly to the partition or wall.

While the adaptor kit of the present invention can be readily configured and designed to fit any number of types of cabinets that have individual storage compartments associated therewith, one type of portable cabinet that has been found to readily adapt itself to the multi-use purpose intended in accordance with the present invention is a fishing tackle-type cabinet that has a plurality of individual trays slideable into and out of a single compartment with each of the trays being subdivided to define a plurality of open-topped bins which can be further sub-divided to individually house different discrete articles. The cabinet that is envisioned for use is one that has a removable cover that can be closed and latched to maintain the trays in a closed position within the compartment during storage and transportation. The cabinet described above also has a carrying handle and is sized and configured to be easily carried by one hand from one point to another.

BRIEF DESCRIPTION OF SEVERAL VIEWS OF DRAWINGS

FIG. 1 of the drawings shows a perspective view of a portable cabinet that has been converted into a merchandising and display device in accordance with the teachings of the present invention;

DETAILED DESCRIPTION

Figure 1:
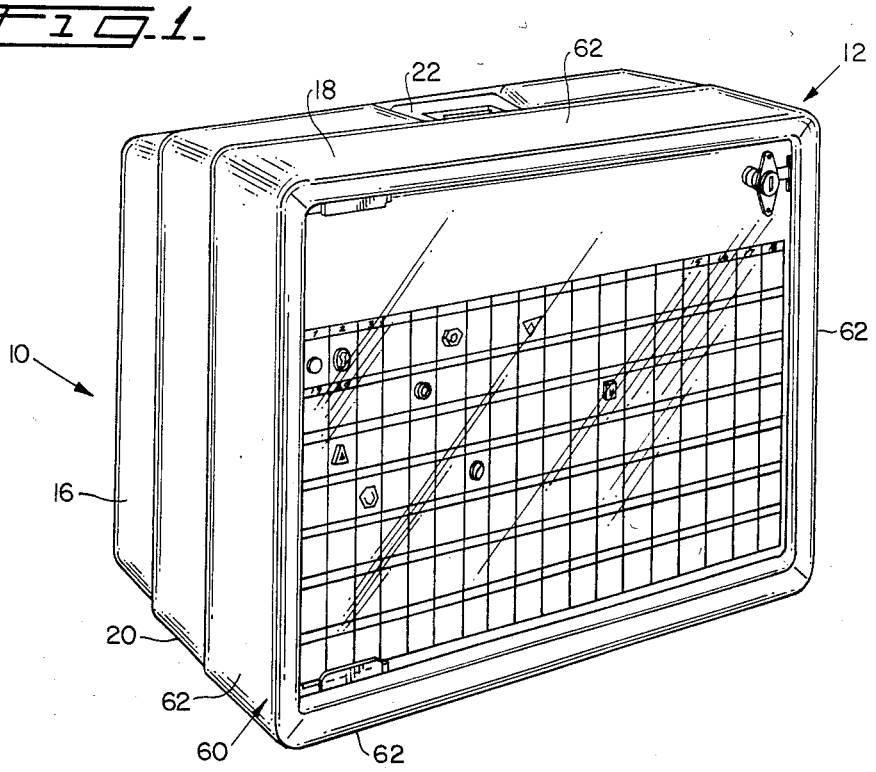

While this invention is susceptible of embodiment in many different forms, there is shown in the drawings and will herein be described in detail a preferred embodiment of the invention with the understanding that the present disclosure is to be considered as an exemplification of the principles of the invention and is not intended to limit the broad aspect of the invention to the embodiment illustrated.

FIG. 1 of the drawings shows cabinet generally designated by reference numeral 10, which can be a commercially-available a cabinet that is a stock item in many merchandising stores and is converted to a merchandising and display device with the adaptor or conversion kit, designated by reference numeral 12, constructed in accordance with the teachings of the present invention.

Figure 4:
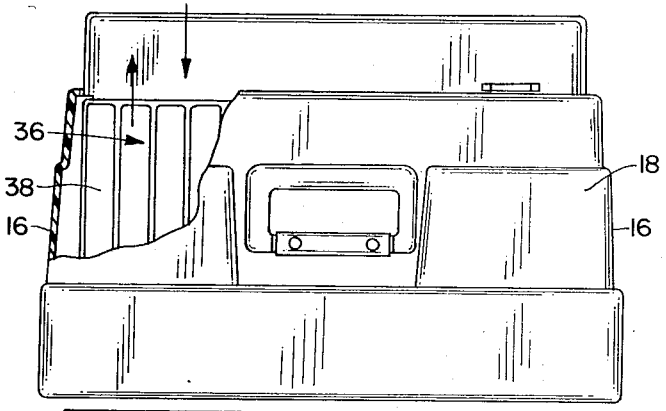
FIG. 4 is a top view, partly in section, of the device shown in FIG. 1; and, FIG. 5 is a rear view of the device shown in FIG. 1 with the cover in an open position.
Figure 5:
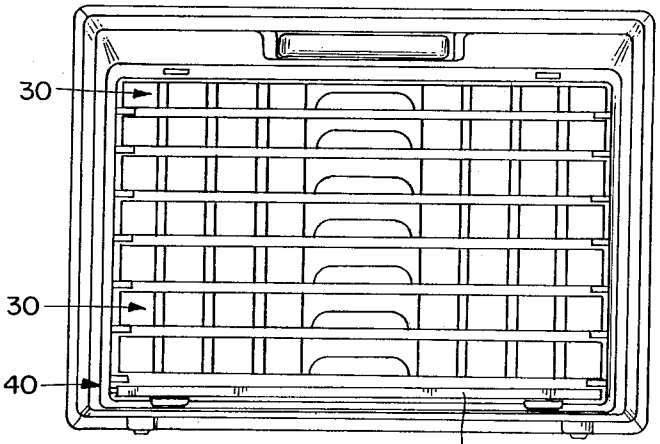

The cabinet 10 which, as indicated above, may be a cabinet that is marketed as a tackle box, includes a pair of side walls 16, a top wall 18 and a bottom wall 20. The top walls generally has a carrying handle 22 associated therewith and the walls 16, 18 and 20 cooperate to define an enclosed compartment, generally designated at 24 in FIG. 3. The compartment 24 defined by side walls, top wall and bottom wall, is preferably, although not necessarily, closed at its forward end by a suitable front wall 26, but such closure is not necessary for the purposes of the present invention. The cabinet 10 envisioned for use with the present invention has a plurality of groups of trays 30 which are slideable into and out of the compartment 24 through the rear open end 32 of the cabinet 10 and the trays are preferably configured so as to be completely within the compartment 24 when fully inserted therein so that the rear open end 32 defines a generally flush rear surface which can easily be closed by a removable cover 34. As illustrated in FIG. 4, each of the trays 30 is divided into a plurality of open-topped bins 36 which can further be sub-divided by partitioning walls 38 so that each bin can house a plurality of articles, as will be explained later.

Figure 3:
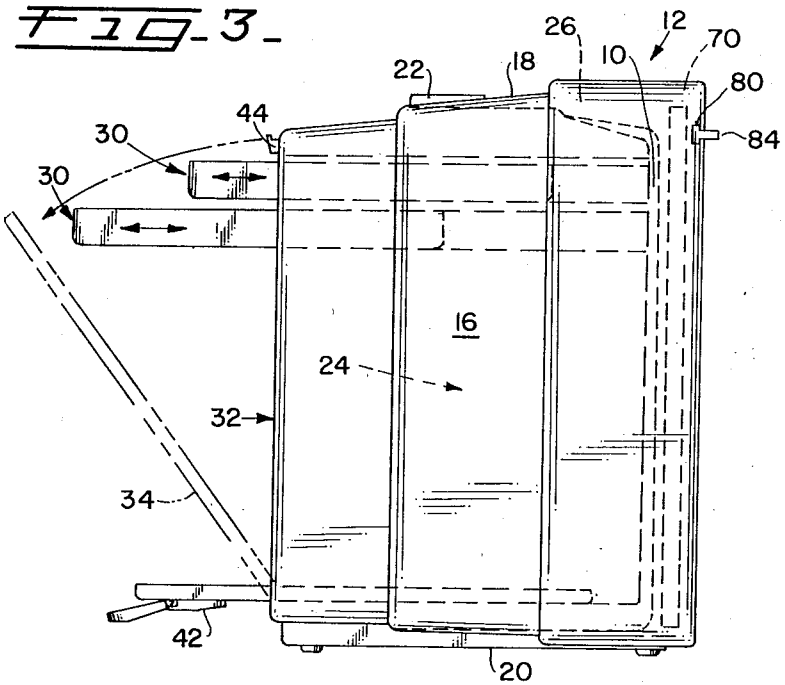
FIG. 3 is a side elevational view of the device shown in FIG. 1.

The removable cover 34 is preferably of the type that can easily be latched to a closed position so that all of the trays are locked within the compartment 24 and yet can readily and quickly be opened for slideably removing any of the trays 30. Thus, as illustrated in FIG. 3, the cover 34 preferably has guide pins and other guide elements (not shown) at the lower opposite side edges thereof which may be received into guide slots at opposite ends of an elongated lower slot 40 defined at the lower end of the compartment 24. The guide slot (not shown) may be positioned and configured such that the pins slideable therein may be moved to a position where the cover can easily be slid from the stored position rearwardly and then pivoted upwardly to close the rear end 32 of the cabinet 10. Cover 34 may have one or more latches 42 at the upper end thereof, which cooperate with latch pins 44 on the upper end of the cabinet so that the cover can be latched in a closed position and enclose the respective trays in a closed position.

All of the cabinet and associated elements are preferably features that are found in a commercially-available cabinet that can be purchased off the shelf. Such a cabinet can easily be converted, according to the present invention, into a merchandising and display device by the adaptor 12, which will now be described in detail with particular reference to FIGS. 1 and 2.

The adaptor kit 12 preferably has a connecting means for securement to the cabinet and the illustrative connecting means is shown as a frame structure, generally designated by reference numeral 60, that consists of four frame elements or members 62 which may be conventional boards that are mitered at the respective corners and interconnected to define a generally hollow passage therein, the inner periphery of which conforms to the outer periphery of the front portion of the cabinet 10. The frame members 62 are secured to cabinet 10 by suitable fasteners, such as screws 64, but other types of fastening means may be used.

Figure 2:
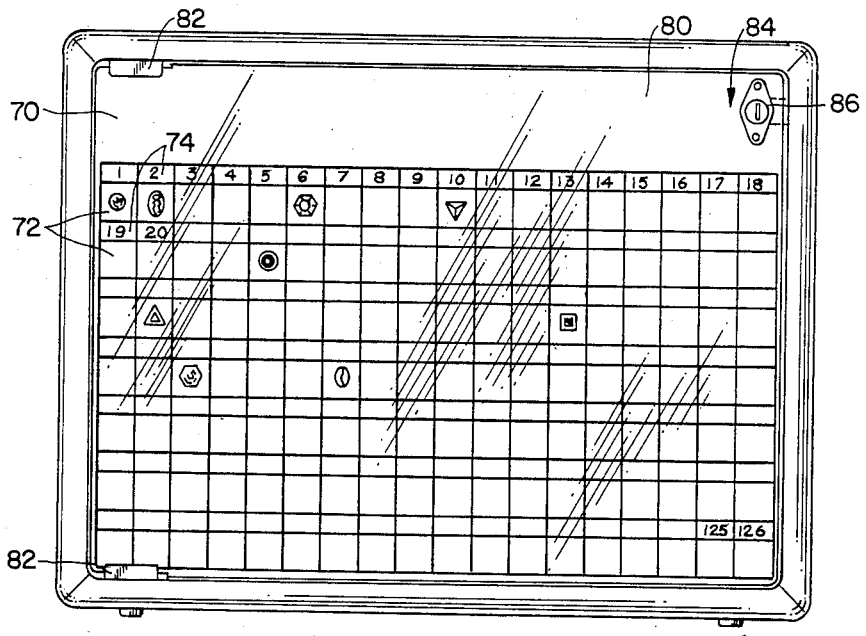
FIG. 2 is a front elevational view of the device shown in FIG. 1.

The adaptor kit 12 has a removable partition or wall 70 that is carried by the frame structure or connecting means 60 and closes off the hollow passage between the front and rear open ends. As shown in FIG. 2, the partition or wall 70 has a front surface which defines a display surface and the display surface is divided into a plurality of individual segments 72 which may be identical in configuration to each other or may take varying shapes and sizes, dependent upon the discrete articles that are intended to be merchandised. Each of the individual display segments has an individual identifying indicia 74, such as a number, associated therewith. By way of example and not of limitation, the individual segments 72 may be arranged in rows equal to the number of trays 30 and occupy a space that is generally equal to the space occupied by each of the trays in the compartment 24. Each of the individual segments 72 can thus be easily correlated with corresponding indicia identical to the indicia 74 appearing on the display surface, such as the sequential numbering system shown in FIG. 2 and the respective numbers can be removably attached to the rear exposed surface of the respective trays, and more particularly with the respective bins 36.

The partition or wall 70 is preferably of the type that is easily penetratable with a sharp object, such as a pin, that is normally associated with the discrete articles that are illustrated in FIG. 2, so that the pin that normally has a backing element or clip associate therewith can be attached to the display surface by penetrating the wall 70.

According to one aspect of the present invention, the adaptor or conversion kit 12 also has a transparent cover releasably secured to the frame structure 60 for covering the display suface and enclosing the discrete articles carried on the display surface. The transparent cover 80, which may be formed of glass or plastic, is preferably releasably retained on the frame structure 60 and, for this purpose, the frame elements carry a pair of opposited brackets 82 adjacent an upper and lower end corner of the frame structure, which respectively define slots or guides for receiving opposite edges of the generally rectangular cover 80. A lock 84, which may be a readily available lock utilized in display of merchandise articles, is preferably attached to an opposite corner of the cover 80 and has a latch element 86 which is received into a cooperating guide or slot in one of the frame elements 62. The lock 84 is preferably of the type that is now used in many stores for locking of glass display devices, which can easily be unlocked utilizing a key that is maintained by the merchandiser so that the articles will remain in fully-exposed view for the prospective purchaser while still being secured under lock and key.

As can be appreciated from the above description, the adaptor or conversion kit 12 for converting a conventional storage and transporting cabinet can readily be manufactured at a minimum cost and minimum time by the merchandiser and then can easily be assembled onto a cabinet 10 that is also a readily-available purchaseable item. After the merchandising and display device has been assembled as shown in FIG. 1, a wholesaler or distributor of small discrete articles, such as pins, can easily outfit an ultimate merchandiser with a complete stock of a variety of such discrete aticles by displaying the articles on the individual segments 72 on the display surface defined by the wall 70 and then can be placed under lock and key with the transparent cover 80, while still being readily accessible for viewing by the prospective purchaser. A supply of each of the individual discrete articles displayed on the front surface of the merchandising and display device can then be stored in the respective bins 36 defined in the respective trays 30 and the corresponding identifying indicia on the ends of the trays can be utilized by the merchandiser and readily located and supply the article to the purchaser or consumer.

With the arrangement described above, a wholesaler or manufacturer of pins of the type envisioned for sale with this type of merchandising and display device can easily outfit an entire portable cabinet with more than 100 different types, sizes, configurations and shapes of discrete articles and, at the same time, provide the merchandiser with a stock of such articles in the same portable cabinet. The entire portable cabinet already stocked can then be delivered to the merchandiser and all the merchandiser needs to do is to set the merchandising and display device onto a shelf or other support surface in clear view for the consumer.

While a specific embodiment has been described for a particular use, numerous modifications come to mind without departing from the spirit of the present invention. For example, the portable cabinet need not be a commercially-available item that can be purchased and, in fact, could easily be mass produced to a particular configuration and size dependent upon the articles that are intended to be displayed. Of course, the frame structure or connecting means could also take various other forms and could be a molded unit rather than the individual elements described above and the size and configuration of the trays and drawer divisions therein can be varied according to the product line being displayed.

I claim:

1. In combination with a portable cabinet having top, bottom and side walls defining an enclosed compartment closed at one end of said walls by a front wall and open at its opposite end with a plurality of trays slideable into said compartment from said opposite end and a removable cover closing said opposite end to enclose said trays in said compartment, the improvement of a display attachment attached to said cabinet and including a front defining a display surface and having frame-type connecting means secured to said cabinet with said display surface being divided into a plurality of individual segments, each individual segment having individual identifying indicia thereon, a transparent cover releasably secured to said front and covering said display surface for enclosing discrete articles on respective segments of said display surface while accommodating visual inspection thereof, said connecting means having brackets secured thereto defining slots for receiving edges of said transparent cover and a lock on said transparent cover for locking said transparent cover to said display attachment, and a plurality of corresponding indicia equal in number and identification to said individual identifying indicia and attached to exposed surface of said trays at said opposite end of said cabinet so that a supply of discrete articles for each of said discrete articles displayed on said display surface can be stored in said trays in corrolated relation using said indicia and individual discrete articles can readily be located in said trays upon request by a consumer viewing the display surface.

2. The combination as defined in claim 1, in which said connecting means includes extensions extending from said front and surrounding said walls with fasteners extending through said extensions and said walls for securing said display attachment to said cabinet.

3. An adaptor kit for converting a portable cabinet having a plurality of walls defining a compartment closed at one end and having an opposite open end with a plurality of open-topped trays slideble through said open end into said compartment and a removable cover for closing said open end, said adaptor comprising a frame structure defining a hollow passage conforming to a peripheral configuration of said walls and adapted to be telescoped over said one end into juxtaposed position with said walls of said cabinet with fastener means for securing said frame structure to said walls, a partition in said frame structure closing said hollow passage and defining a display surface for a plurality of discrete articles, said display surface being divided into a plurality of individual display segments, each having individual identifying indicia thereon, a transparent cover received into said frame structure to enclose said display surface and releasably secured thereto, said frame structure having a bracket means defining opposite slots for receiving opposite edges of said transparent cover and said transparent cover having lock means on an upper portion for securing said transparent cover to said frame structure, and a plurality of corresponding individual identifying indicia adapted to be attached to said trays so that discrete articles can be displayed on said display surface and a supply of each discrete article can be stored in said trays and located with said indicia.

* * * * *